US006010318A

United States Patent [19]

Li

[11] Patent Number: 6,010,318

[45] Date of Patent: Jan. 4, 2000

[54] ELECTRIC FAN WITH LUBRICATING OIL LEAKAGE PREVENTIVE ARRANGEMENT

[76] Inventor: Wen-Sheng Li, No. 148, Tai-He Rd., Chu-Pei City, Hsinchu Hsien, Taiwan

[21] Appl. No.: 09/338,495

[22] Filed: Jun. 23, 1999

[51] Int. Cl.[7] ..... F04D 29/12

[52] U.S. Cl. ..... 417/423.13; 415/230; 415/229

[58] Field of Search ..... 417/423.13, 423.11, 417/423.14, 423.1; 415/229, 230, 11, 168.2, 168.4

[56] References Cited

U.S. PATENT DOCUMENTS

| | | | |
|---|---|---|---|
| 1,367,450 | 2/1921 | Barnickol et al. | 417/123.14 |
| 3,137,237 | 6/1964 | Zagar et al. | 417/123.1 |
| 5,302,091 | 4/1994 | Horiuchi | 417/420 |
| 5,441,386 | 8/1995 | Hsieh | 415/230 |
| 5,639,165 | 6/1997 | Aizawa et al. | 384/315 |
| 5,658,127 | 8/1997 | Bond et al. | 415/112 |

*Primary Examiner*—Charles G. Freay
*Assistant Examiner*—Robert Z. Evora
*Attorney, Agent, or Firm*—Bacon & Thomas

[57] ABSTRACT

An electric fan, which includes a body having a center shaft defining an axially extended center axle hole, a fan blade assembly having a hub and an axle axially disposed at the center of the hub and coupled to the center axle hole of the center shaft, and a lubricating axle bearing mounted within the axle hole of the center shaft around the axle, wherein the center shaft has a stop flange axially forwardly raised from the periphery of the top end thereof and defining a receiving chamber; the hub has an oil groove on the inside around the axle for receiving lubricating oil from the lubricating axle bearing when the electric fan is turned upside-down during a repair work; an oil return wheel is mounted on the axle and received in the receiving chamber defined within the stop flange of the center shaft for guiding lubricating oil back from the oil groove to the lubricating axle bearing after a repair work of the electric fan.

1 Claim, 5 Drawing Sheets

ELECTRIC FAN WITH LUBRICATING OIL LEAKAGE PREVENTIVE ARRANGEMENT

BACKGROUND OF THE INVENTION

The present invention relates to an electric fan, and more specifically to a lubricating oil leakage preventive arrangement for an electric fan, which prevents a loss of lubricating oil from the lubricating axle bearing.

A variety of miniature electric fans have been disclosed for use in electronic apparatus (for example, computer mainframe, video cassette recorder, copy machine, etc.) to dissipate heat, so as to prevent a damage to electronic parts due to an overheat. FIG. 1A shows a prior art electric fan for this purpose. This structure of electric fan comprises a body, a fan blade assembly, and a lubricating axle bearing. The body comprises a seat at the center, a center shaft disposed at the center of the seat and defining an axially extended center axle hole, a winding and a circuit board mounted in the seat around the center shaft. The fan blade assembly comprises a cup-like hub, a plurality of fixed blades equiangularly and obliquely spaced around the hub, a magnet mounted within the hub, and an axle axially disposed at the center of the hub and coupled to the center axle hole of the center shaft at the body. The lubricating axle bearing is mounted within the axle hole of the center shaft around the axle of the fan blade assembly for releasing lubricating oil upon rotary motion of the axle. This structure of electric fan is still not satisfactory in function. During rotary motion of the axle in the lubricating axle bearing, a centrifugal force is produced, and lubricating oil tends to be forced out of the axle bearing and the shaft by the centrifugal force (see FIG. 1B). Therefore, lubricating oil reduces quickly with the use of the electric fan. Insufficient application of lubricating oil to the contact area between the axle and the lubricating axle bearing causes the axle to wear quickly, and a high noise will be produced during rotary motion of the axle.

SUMMARY OF THE INVENTION

The present invention has been accomplished to provide an electric fan, which eliminates the aforesaid problem. According to the present invention, the center shaft of the body is made having a stop flange axially forwardly raised from the periphery of the top end thereof and defining a receiving chamber, the hub of the fan blade assembly is made having an oil groove on the inside around the axle for receiving lubricating oil from the lubricating axle bearing when the electric fan is turned upside-down during a repair work, and an oil return wheel is mounted on the axle and received in the receiving chamber defined within the stop flange of the center shaft for guiding lubricating oil back from the oil groove to the lubricating axle bearing after a repair work of the electric fan.

DETAILED DESCRIPTION OF THE PREFERRED EMBODIMENT

Figure 1A:
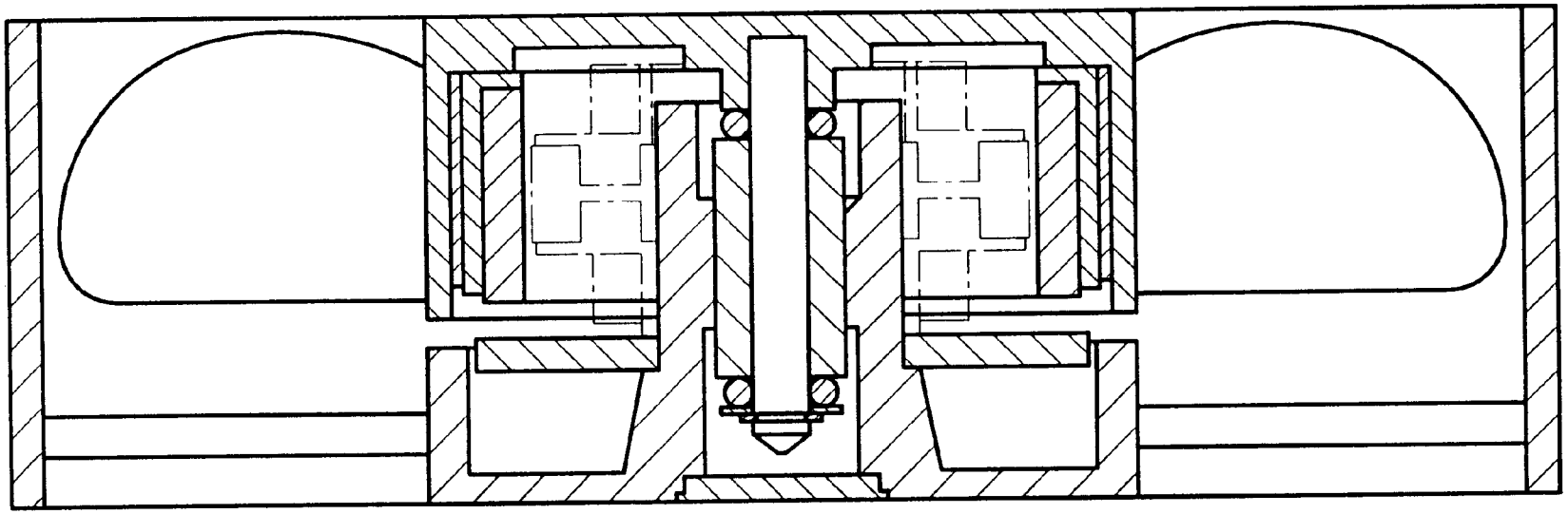
Fig. 1A PRIOR ART
FIG. 1A is a sectional view of an electric fan according to the prior art.
Figure 1B:
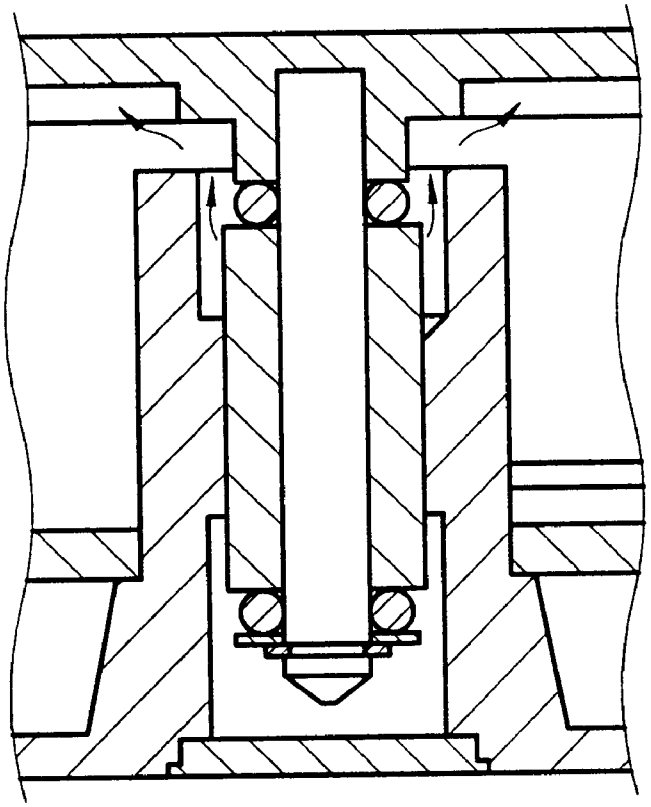
Fig. 1B PRIOR ART
FIG. 1B is an enlarged view of a part of FIG. 1A.
Figure 2:
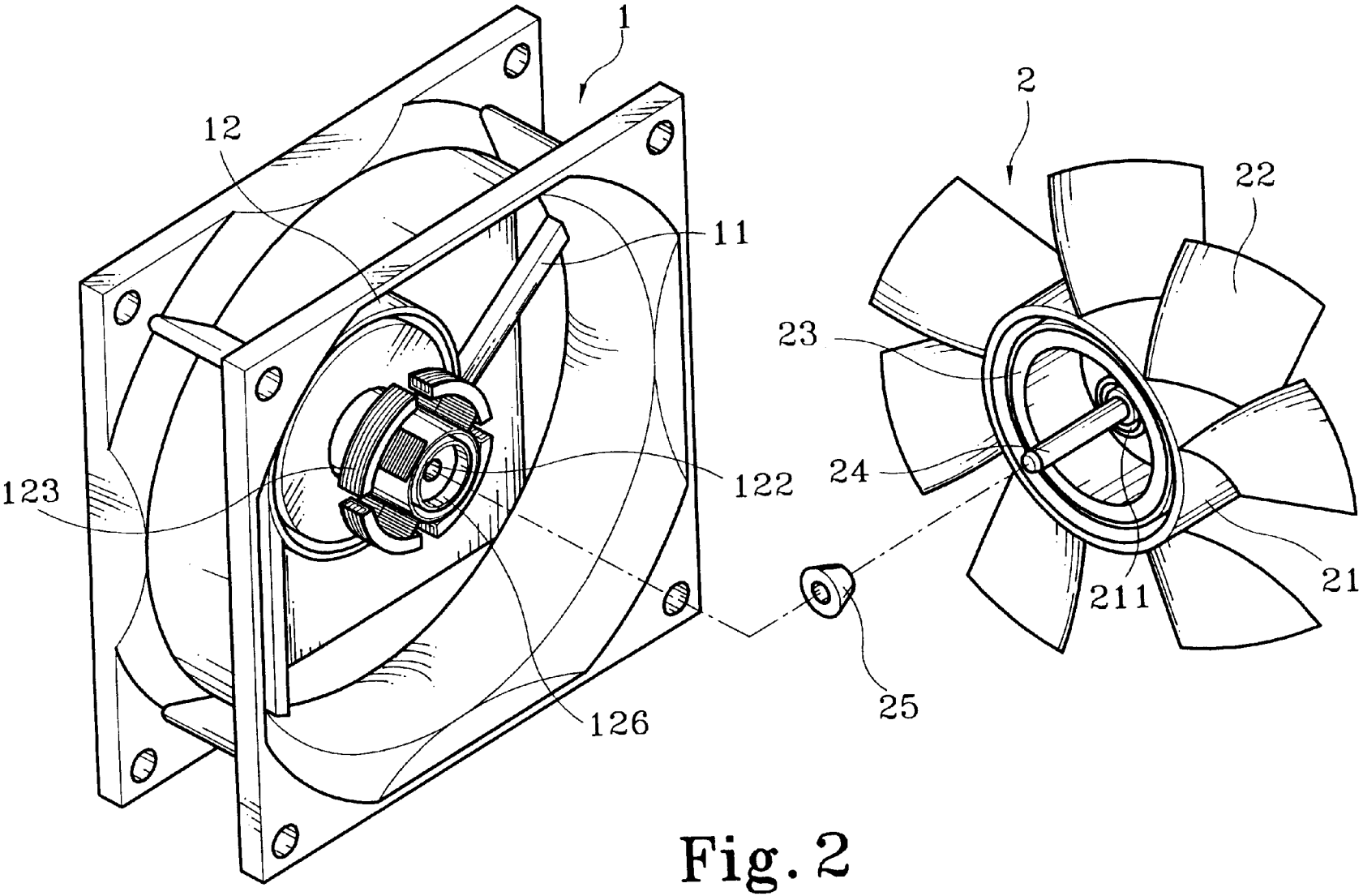
FIG. 2 is an exploded view of an electric fan according to the present invention.
Figure 3:
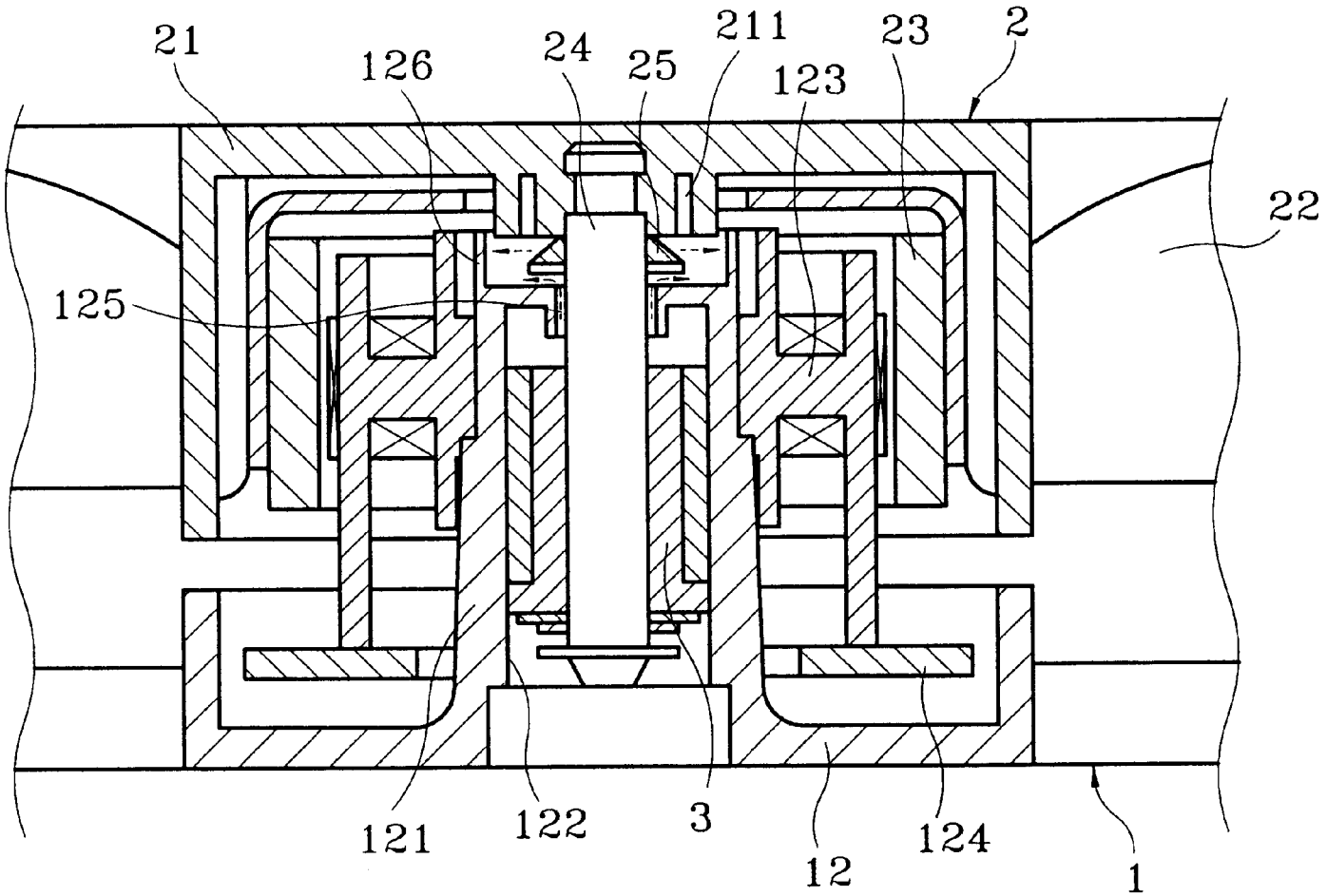
FIG. 3 is a sectional assembly view in an enlarged scale of a part of the electric fan shown in FIG. 2.

Referring to FIGS. 2 and 3, an electric fan is shown comprising a body 1, a fan blade assembly 2, and a lubricating axle bearing 3. The body 1 comprises a plurality of ribs 11, a seat 12 fixedly secured to the ribs 11 and disposed at the center, a center shaft 121 disposed at the center of the seat 12 and defining an axially extended center axle hole 122, a winding 123 and a circuit board 124 mounted in the seat 12 around the center shaft 121. The center shaft 121 comprises a stop flange 126 raised from the top end 125 thereof around the periphery. The stop flange 126 defines with the top end 125 of the center shaft 121 a recess. The fan blade assembly 2 comprises a cup-like hub 21, a plurality of blades 22 equiangularly and obliquely spaced around the hub 21, a magnet 23 mounted within the hub 21, and an axle 24 axially disposed at the center of the hub 21 and coupled to the center axle hole 122 of the center shaft 121. The hub 21 comprises an oil groove 211 on the inside around the axle 24. The lubricating axle bearing 3 is mounted within the axle hole 122 of the center shaft 121 around the axle 24 of the fan blade assembly 2. The lubricating axle bearing 3 is made copper alloy through a sinter process, containing a big amount of lubricating oil for lubrication. Further, a tapered oil return wheel 25 is firmly mounted on the axle 24 inside the hub 21.

Figure 4:
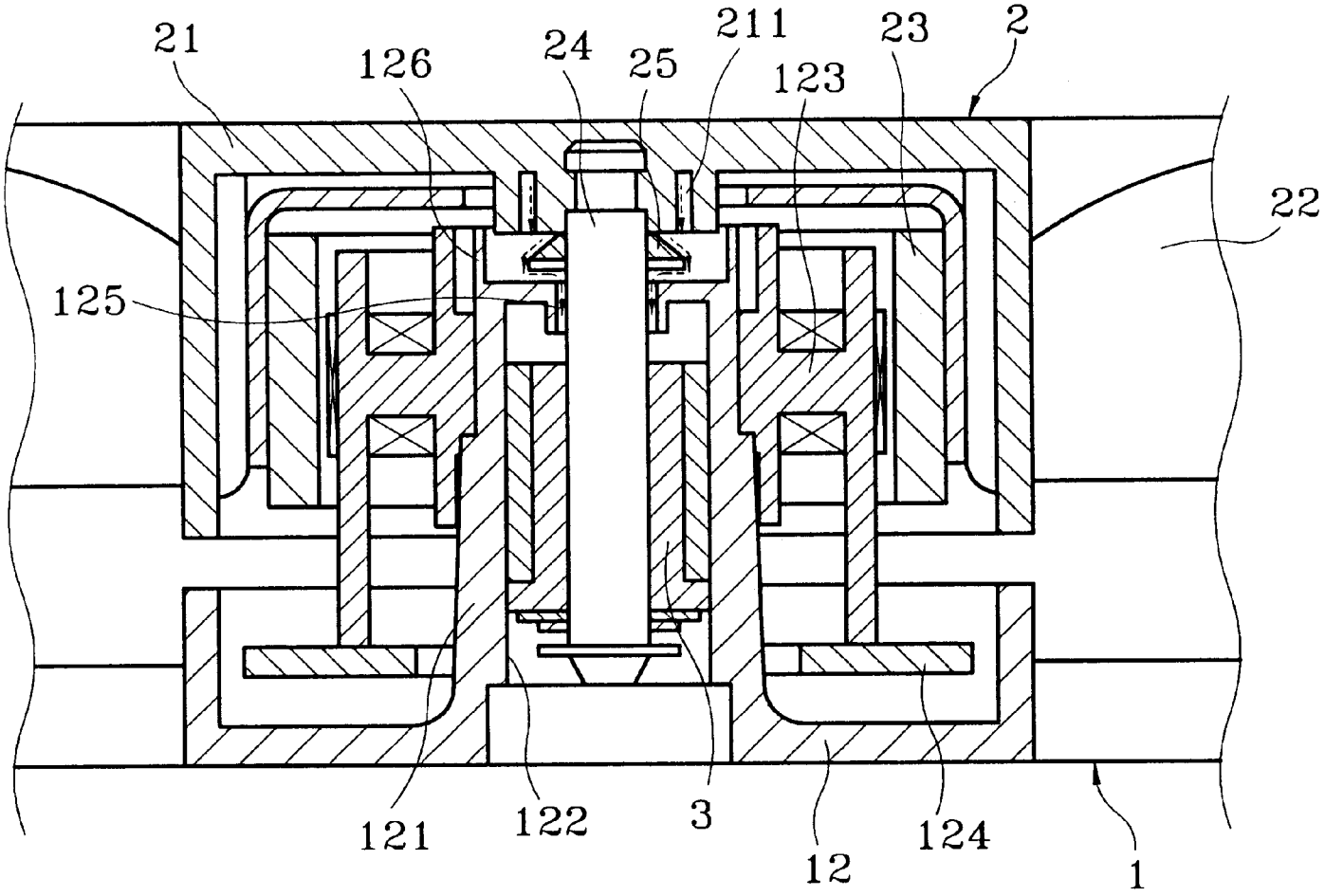
FIG. 4 is a sectional view of the present invention, showing lubricating oil returned from the oil groove to the lubricating axle bearing.

Referring to FIGS. 3 and 4, when the axle 24 is induced to rotate, the hub 21 is rotated with the axle 24, and the blades 22 are moved with the hub 21 to cause currents of air. During rotary motion of the axle 24 in the lubricating axle bearing 3, a suction force is produced to suck lubricating oil from sintered holes in the lubricating axle bearing 3, thereby causing the contact area between the axle 24 and the lubricating axle bearing 3 to be lubricated to reduce the related coefficient of friction. Because the stop flange 126 is raised from the top end 125 of the center shaft 121 and the oil return wheel 25 is suspended in the recess defined within the stop flange 126, lubricating oil is stopped from escaping out of the fan blade assembly 2 and the center shaft 121. When the electric fan is stopped, lubricating oil immediately flows back to the inside of the lubricating axle bearing 3.

When turning the electric fan upside-down during an assembly or repair work, excessive lubricating oil falls out of the top end 125 of the center shaft 121 to the oil groove 211 in the hub 21 to prevent a contamination. After the assembly or repair work, the electric fan is turned back, and lubricating oil is drawn back along the periphery of the oil return wheel 25 to the inside of the lubricating axle bearing 3 by means of a syphonic action.

As indicated above, the design of the present invention prevents a lubricating oil loss, and enables lubricating oil to be recycled, therefore the service life of the electric fan is greatly prolonged.

What is claimed is:

1. An electric fan comprising:

a body, said body comprising a seat at the center, a center shaft disposed at the center of said seat and defining an axially extended center axle hole, a winding and a circuit board mounted in said seat around said center shaft;

a fan blade assembly, said fan blade assembly comprising a cup-like hub, a plurality of fixed blades equiangularly and obliquely spaced around said hub, a magnet mounted within said hub, and an axle axially disposed at the center of said hub and coupled to the center axle hole of said center shaft at said body; and a lubricating axle bearing mounted within the axle hole of said center shaft around said axle of said fan blade assembly for releasing a lubricating oil upon rotary motion of said axle; wherein said center shaft comprises a stop flange axially forwardly raised from the periphery of a top end thereof and defining with said top end a receiving chamber; said hub comprises an oil groove on the inside around said axle for receiving and holding said lubricating oil from said lubricating axle bearing when the electric fan is turned upside-down during a repair work; said fan blade assembly further comprises an oil return wheel mounted on said axle and received in the receiving chamber defined within the stop flange of said center shaft for guiding said lubricating oil back from said oil groove to said lubricating axle bearing after a repair work of the electric fan.

* * * * *